426-919 SR
5/14/85 XR 4,517,230

United States Patent [19]

Crawford

[11] Patent Number: 4,517,230

[45] Date of Patent: May 14, 1985

[54] ARTIFICIAL CAMOUFLAGE LEAF CONSTRUCTION

[76] Inventor: Tad E. Crawford, 6645 Cleveland Ave. S., East Sparta, Ohio 44626

[21] Appl. No.: 587,600

[22] Filed: Mar. 8, 1984

[51] Int. Cl.[3] ..... F41H 3/00

[52] U.S. Cl. ..... 428/17; 2/DIG. 6; 2/94; 428/21; 428/100; 428/919

[58] Field of Search ..... 428/21, 100, 919, 17, 428/26; 2/DIG. 6, 94

[56] References Cited

U.S. PATENT DOCUMENTS

| | | | |
|---|---|---|---|
| 1,139,642 | 5/1915 | Cox | 428/919 X |
| 1,291,809 | 1/1919 | Ekker | 428/919 X |
| 2,344,846 | 3/1944 | Berg | 428/21 X |
| 2,744,348 | 5/1956 | Smith | 428/919 X |
| 3,316,669 | 5/1967 | Nachbar | 428/100 X |
| 3,484,974 | 12/1969 | Culmone | 428/100 X |
| 3,922,455 | 11/1975 | Brumlik | 428/85 |
| 4,106,124 | 8/1978 | Green | 428/919 X |
| 4,249,268 | 2/1981 | Berler | 428/100 X |

*Primary Examiner*—Henry F. Epstein
*Attorney, Agent, or Firm*—Michael Sand Co.

[57] ABSTRACT

An artificial leaf for camouflaging a hunter's clothing and equipment by providing a three dimensional effect to destroy his silhouette and making him less visible and suspicious to game. A piece of polyester fabric material is formed into the shape of a leaf and a stem of monofilament nylon is attached to the simulated leaf by seam-tape. A plurality of the artificial leaves are permanently attached to a strip of separable fastening material. Another strip of separable fastening material is permanently attached to the hunter's clothing or equipment for removably attaching the other strip of fastening material thereto. The leaf stems have memory and are bent so that the leaves extend outwardly from the hunter or equipment to provide the three dimensional camouflage effect thereto.

6 Claims, 7 Drawing Figures

4

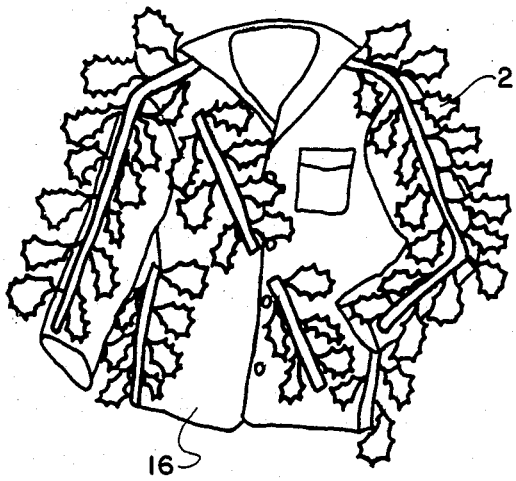
FIG. 1
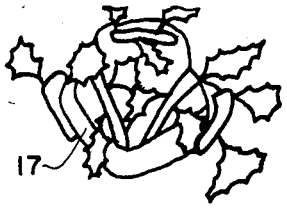
FIG. 2
FIG. 3
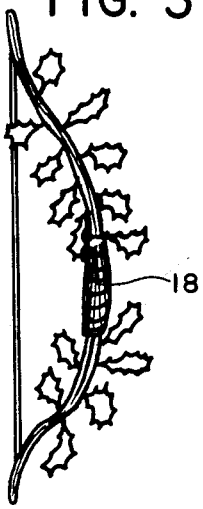
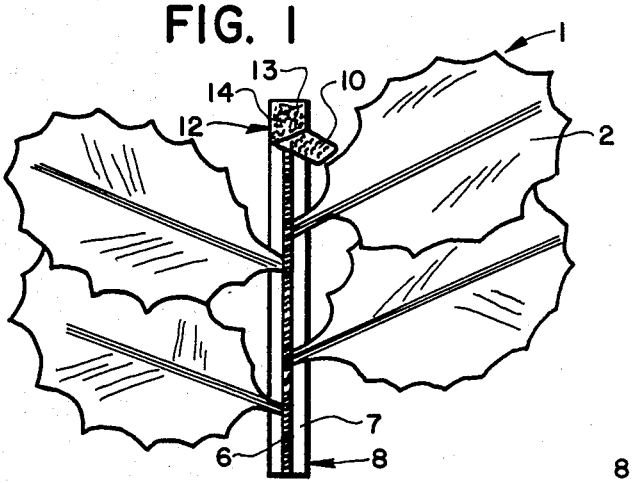
FIG. 4
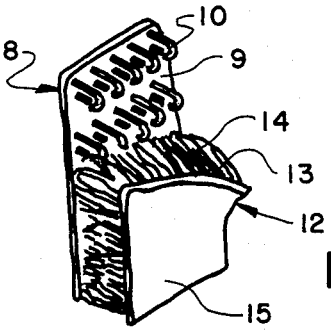
FIG. 7
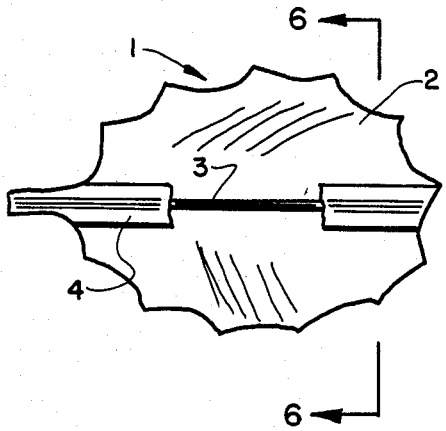
FIG. 5
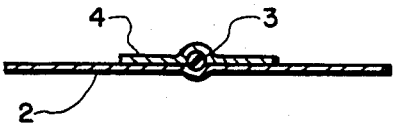
FIG. 6

ARTIFICIAL CAMOUFLAGE LEAF CONSTRUCTION

TECHNICAL FIELD

The invention relates to camouflage for hunter's and their equipment and in particular to a leaf construction for attaching to the hunter and hunting equipment to provide a three dimensional effect thereto and destroying the silhouette produced by the hunter and equipment.

BACKGROUND ART

Hunters wear various colored clothing in an attempt to match the color of the surrounding foilage so as to be less susceptible to detection by the animal game. Although camouflage clothing does assist in hiding the hunter from the game, the game still can identify the silhouette of the hunter or hunting equipment such as a bow, a tree stand, gun, or the like and be spooked for no other reason. The silhouette of the hunter is very suspicious and dangerous to the game especially when at close range which provides the best shot at the game. It is in these situations that the hunter will attempt to hide behind brush or a tree to eliminate or reduce his silhouette. However, effective concealment is not always available to the hunter especially if he is moving through the forest.

Hunters in the past have tried to overcome this problem by the use of camouflaging as shown in Pat. Nos. 1,139,624 and 2,744,348. Although such camouflage does provide some concealing effect, it does not adequately destroy the hunter's silhouette or provide versatility in its use. For example, the camouflage is not easily changeable to match the particular foilage in which the hunter will be located since the color of the leaves and foilage will change as the seasons change, and also it depends upon the geographical location. Also, the hunter may have more than one hunting coat and other pieces of clothing and equipment which involves a greater expense for providing a camouflage for all such equipment even though only part of the equipment and clothing will be used at any one time.

Therefore, the need has existed for an improved camouflage which is removably attached to the hunter's clothing and equipment, and which can be made in different colors to match the surrounding foilage.

DISCLOSURE OF THE INVENTION

Objectives of the invention include providing an improved artificial camouflage leaf which is permanently attached to one piece of a separable fabric fastening material such as Velcro, for removable placement on a second piece of such separable fabric fastening material which is permanently attached to the hunter's clothing or equipment; and which enables various camouflage patterns to be placed on the clothing and equipment only when worn or used by the hunter. A further objective is to provide such a leaf construction in which the leaf can be made of lightweight and noiseless material such as a combined polyester and cotton fabric which will flutter slightly in the breeze or wind providing a motion corresponding to the movement of the natural leaves in the area, which is not easily damaged as the hunter moves through the foilage, and which can be formed in various colors to match the particular seasonal condition of the leaves in a particular geographical location.

A further objective of the invention is to provide such an improved camouflage leaf construction in which the simulated fabric leaf has a stem formed of a nonrusting monofilament strand material which has sufficient memory which allows the leaf to be curled or kinked to enable the leaf to "stand up" from an applied surface, and in which the stem has sufficient memory to stay in its formed condition even when contacted or bent by contacting adjacent foilage or other obstacles. Another objective is to provide such a leaf construction which can be applied to any type of equipment such as bows, guns, tree stands or the like as well as at any location on the hunter's jacket, hat, or pants, and which can be easily removed from the clothing and equipment for cleaning of the leaf or clothing and equipment without damaging either the leaf or the attached clothing or equipment.

Another objective of the invention is to provide such a camouflage leaf construction in which the stem may be attached easily to the simulated fabric leaf by seam tape, in which the fabric leaf and stem then can be permanently attached to one strip of the Velcro material by sewing or by an adhesive. A still further objective is to provide such a leaf construction which can be produced in various lengths for manufacture and sale and then cut to the desired length by the purchaser, and in which the leaf is relatively inexpensive, long lasting and eliminates difficulties existing in the art with prior camouflage materials.

These objectives and advantages are obtained by the improved artificial camouflage leaf construction which is adapted to be attached to a hunter's clothing or equipment, the general nature of said leaf construction including a first elongated piece of separable fabric fastening material adapted to be permanently secured to the hunter's clothing or equipment; a second elongated piece of separable fabric fastening material for removable attachment to said first piece of fastening material; a piece of fabric shaped to simulate a leaf; a stem secured to the fabric leaf and extending generally throughout the length thereof, said stem being flexible with sufficient memory to retain a shape imparted thereto; and attachment means for securing the fabric leaf and stem to the second piece of fastening material whereby said fabric leaf and stem is removably attached to the hunter's clothing or equipment and the stem bent so that the fabric leaf projects outwardly from the clothing or equipment disrupting the silhouette thereof.

BRIEF DESCRIPTION OF THE DRAWINGS

A preferred embodiment of the invention, illustrative of the best mode in which applicant has contemplated applying the principle, is set forth in the following description and shown in the drawings and is particularly and distinctly pointed out and set forth in the appended claims.

FIG. 1 is a diagrammatic perspective view showing a hunter's coat having a plurality of the artificial camouflage leaves attached thereto;

FIG. 2 is a diagrammatic perspective view of a hunter's hat having a plurality of the improved artificial camouflage leaves attached thereto;

FIG. 3 is a diagrammatic perspective view showing a hunting bow having the camouflage leaves attached thereto;

FIG. 4 is an enlarged plan view showing a plurality of the camouflage leaves attached to one elongated piece of separable fabric fastening material which in turn is attached to a second piece of such fastening material;

FIG. 5 is an enlarged plan view with portions broken away, of one of the camouflage leaves;

FIG. 6 is an enlarged sectional view taken on line 6—6, FIG. 5; and

FIG. 7 is a greatly enlarged fragmentary view of the separable fastening strips.

Similar numerals refer to similar parts throughout the drawings.

BEST MODE FOR CARRYING OUT THE INVENTION

The improved artificial camouflage leaf construction is indicated generally at 1, and is shown particularly in FIGS. 4 and 5. Leaf 1 includes a piece of fabric 2 shaped to simulate a leaf and has a stem 3 attached thereto preferably by a strip of seam tape 4 (FIGS. 5 and 6). Fabric 2 preferably is formed of a broad cloth comprising of a blend of 70% polyester and 30% cotton. Such fabric material is very resistant to weather and discoloration and can be purchased in various colors enabling the leaf to match the particular foilage of the geographical area in which the artificial leaf is intended for use by the hunter. The fabric also provides sufficient stiffness for the leaf enabling it to retain its shape once cut to the desired configuration and is washable and unaffected by the weather.

In accordance with one of the features of the invention, stem 3 is formed of a monofilament nylon strand which has sufficient memory whereby it can be crimped or bent by the hunter between his fingers and thumb and will retain this shape. The stem also has sufficient flexibility enabling the leaf and stem to bend upon contacting the underbrush and to move or blow in the breeze or wind.

One type of strand material found satisfactory for the intended use has a diameter of approximately 0.065 inches and is sold by Berkley & Company of Spirit Lake, Iowa under its catalogue number WCL 3-65. This type of memory strand also is referred to as a weed line and is used in the various types of equipment using a whirling flexible strand material for trimming grass and foilage. Stem 3 is mounted on fabric 2 by seam tape 4 which also is referred to as a bonding web preferably $\frac{3}{4}$ of an inch wide and formed of a 100% polyamide. The seam tape is applied by a heat process such as a heating iron or similar type of heat pressing equipment. Seam tape 4 also will be in colors so as to match the color of the rest of the leaf fabric.

The fabric leaf and attached stem is permanently secured preferably by sewing 6, to side 7 of a first elongated piece of separable fastening material 8. The other side 9 of fabric strip 8 is formed with a plurality of closely spaced hooks 10. Hooks 10 are adapted to be removably attached to side 13 of a second elongated piece of separable fastening material 12 which is formed with a looped pile covering 14. Fastening strips 8 and 12 is of the type of material sold and distributed under the trademark Velcro in which hooks 10 releasably engage pile 14 enabling the materials to be repeatedly joined and separated without affecting the strong bond provided therebetween.

Side 15 of fastening strip 12 is adapted to be permanently secured to various articles of clothing or equipment such as a hunter's coat 16 (FIG. 1), a hunter's hat 17 (FIG. 2) or a hunting bow 18 (FIG. 3). Strip 12 can be attached by a strong adhesive or sewn to coat 16 and hat 17. The simulated leaf and stem then is removably attached to strip 12 by engagement of fabric strip 8 with fabric strip 12. Permanently attached strip 12 can be placed at various locations and extend in various directions with respect to the hunter's clothing and equipment at the hunter's discretion. For example as shown in FIG. 1 long strips of the fastening material containing a plurality of leaves extend along the arms and shoulders of coat 16 which will greatly reduce the hunter's silhouette, in contrast to one or more shorter strip sections which are attached to hat 17 as shown in FIG. 2. Individual leaves also can be attached directly to the bow or other pieces of hunting equipment as shown in FIG. 3.

Preferably a plurality of the artifical leaves are attached by sewing 6 to side 7 of strip 8 enabling the purchaser thereof to cut the fabric strips into the desired lenth depending upon the particular article of clothing or equipment on which the artificial leaf is to be attached. Individual leaves preferably are attached at one inch intervals along strip 8.

Each leaf may be formed in a solid color and shaped for a particular type of foilage such as a maple leaf, oak leaf, pine stem, etc., and for more realism a person may even sketch on the leaf veining with a permanent ink marker. Also, the colors may be shaded or tinted with fabric spray.

Accordingly, the improved artificial camouflage leaf construction has many advantages. It is unaffected by moisture due to the elimination of any metal components since leaf fabric 2 and stem 3 as well as the Velcro strips are relatively unaffected by weather and can be easily cleaned. This enables the leaves to be removably attached to articles of clothing for use with different clothes and equipment with only one portion of the fastener strip remaining on the clothing or equipment. The leaves are silent in that they do not produce any sound as the hunter moves through the woods and underbrush, and most importantly the stem has sufficient memory enabling the hunter to bend the stems whereby the leaves project outwardly from the fabric mounting strips reducing or concealing the silhouette produced by the hunter and his equipment. Furthermore, the leaf can be produced relatively inexpensively and a plurality of the leaves may be attached by sewing 6 or by an adhesive to one side of the elongated fabric strip which can be produced in various lengths for ease of shipment and versatility in use by the hunter.

Although the above discussion refers to the improved camouflage leaf as being used with hunting clothing and equipment, its application need not be so limited. The improved leaf can be applied to other types of clothing and equipment without affecting the concept of the invention and the term hunter and hunting equipment need not be so limited or strictly construed.

Accordingly, the improved artificial camouflage leaf construction is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved artificial camouflage leaf is constructed and used, the characteristics of the construction, and the advantageous, new and useful results obtained; the new and useful structures, devices, elements, arrangements, parts, and combinations, are set forth in the appended claims.

What is claimed is:

1. Artificial camouflage for attaching to a hunter's clothing or equipment, said construction including:

(a) a first elongated piece of separable fabric fastening material adapted to be permanently secured to the hunter's clothing or equipment, said first piece of material having a looped pile covering on an exposed surface thereof when said fastening material is attached to the clothing or equipment;

(b) a second elongated piece of separable fabric fastening material for removable attachment to said first piece of fastening material, said second piece of fabric fastening material having a hooked covering on one side thereof for removable attachment with the looped pile covering of said first fastening material;

(c) a plurality of pieces of fabric shaped to simulate a plurality of leaves;

(d) a stem formed of a nylon monofilament strand secured to each of the fabric leaves and extending generally throughout the length of each leaf, said stems being flexible with sufficient memory to retain a shape imparted thereto; and (e) attachment means for securing the respective fabric leaves and stems in a spaced relationship on the second piece of fastening material whereby said fabric leaves and stems are removably attached in elongated strips to the hunter's clothing or equipment and the stems bent so that the fabric leaves project outwardly from the clothing or equipment disrupting the silhouette thereof.

2. The artificial leaf construction defined in claim 1 in which the simulated leaf is made from a broad cloth including approximately 70% polyester and 30% cotton.

3. The artificial leaf construction defined in claim 1 in which the stem is secured to the simulated leaf fabric with seamtape.

4. The artificial leaf construction defined in claim 3 in which the seamtape is polyamide.

5. The artificial leaf construction defined in claim 1 in which the strand has a diameter of approximately 0.065 inches.

6. The artificial leaf construction defined in claim 1 in which the attachment means is sewing thread.

* * * * *